US009615174B2

(12) United States Patent
Klippel

(10) Patent No.: US 9,615,174 B2
(45) Date of Patent: Apr. 4, 2017

(54) ARRANGEMENT AND METHOD FOR IDENTIFYING AND COMPENSATING NONLINEAR VIBRATION IN AN ELECTRO-MECHANICAL TRANSDUCER

(71) Applicant: Wolfgang Klippel, Dresden (DE)

(72) Inventor: Wolfgang Klippel, Dresden (DE)

( * ) Notice: Subject to any disclaimer, the term of this patent is extended or adjusted under 35 U.S.C. 154(b) by 0 days.

(21) Appl. No.: 14/683,351

(22) Filed: Apr. 10, 2015

(65) Prior Publication Data

US 2015/0296299 A1 Oct. 15, 2015

(30) Foreign Application Priority Data

Apr. 11, 2014 (DE) ..... 10 2014 005 381

(51) Int. Cl.
*H04R 3/04* (2006.01)
*H04R 3/08* (2006.01)

(52) U.S. Cl.
CPC ..... *H04R 3/04* (2013.01); *H04R 3/08* (2013.01)

(58) Field of Classification Search
CPC ..... H04R 3/04; H04R 3/08
(Continued)

(56) References Cited

U.S. PATENT DOCUMENTS 5,148,427 A 9/1992 Buttle et al.
5,329,586 A 7/1994 Agazzi
(Continued)

FOREIGN PATENT DOCUMENTS

WO 2013/009548 A1 1/2013

OTHER PUBLICATIONS

German Office Action for German Patent Application No. 10 2014 005 381.4, dated Jul. 2, 2014, 6 pages.
(Continued)

*Primary Examiner* — Thomas Valone
(74) *Attorney, Agent, or Firm* — Westman, Champlin & Koehler, P.A.

(57) ABSTRACT

The invention relates to an arrangement and a method for converting an input signal v into an output signal $p(r_a)$ by using an electro-mechanical transducer and for reducing nonlinear total distortion $p_d$ in said output signal $p(r_a)$, whereas the nonlinear total distortion $p_d$ contains multi-modal distortion $u_d$ which are generated by nonlinear partial vibration of mechanical transducer components. An identification system generates distributed parameters $P_d$ of a nonlinear wave model ($N_d$) and lumped parameters $P_l$ of a network model ($N_l$) based on electrical, mechanical or acoustical state variables of transducer measured by a sensor. The nonlinear wave model distinguishes between activation modes and transfer modes, whereas the activation modes affect the transfer modes, which transfer the input signal u into the output signal p. A control system synthesizes based on the physical modeling and identified parameters $P_d$ and $P_l$ nonlinear distortion signals $v_d$ and $v_l$ which are supplied with the input signal v to the transducer and compensate for the distortion signals $u_l$ and $u_d$ generated by the transducer nonlinearities.

15 Claims, 15 Drawing Sheets

(58) Field of Classification Search
USPC ..... 324/415
See application file for complete search history.

(56) References Cited

U.S. PATENT DOCUMENTS

| | | | | |
|---|---|---|---|---|
| 6,687,235 | B1 | 2/2004 | Chu | |
| 6,813,311 | B1 | 11/2004 | Pal et al. | |
| 7,970,151 | B2 * | 6/2011 | Oxford | H04M 1/6008 381/122 |
| 8,509,125 | B1 | 8/2013 | Venkataraman | |
| 2003/0142832 | A1 | 7/2003 | Meerkoetter et al. | |
| 2003/0187636 | A1 * | 10/2003 | Klippel | H04R 29/001 704/220 |
| 2005/0003139 | A1 | 1/2005 | Keller | |
| 2005/0175193 | A1 | 8/2005 | Karjalainen et al. | |
| 2013/0216056 | A1 | 8/2013 | Thyssen | |
| 2015/0181318 | A1 * | 6/2015 | Gautama | H04R 1/00 381/59 |

OTHER PUBLICATIONS

Yeh, David T. et al., "Nonlinear Modeling of a Guitar Loudspeaker Cabinet", Proc. of the 11th Int. Conference of Digital Audio Effects (DAFx-08), Espoo, Finland, Sep. 1-4, 2008, 8 pages.

Quaegebeur, Nicolas et al., "Transient modal radiation of axisymmetric sources: application to loudspeakers", hal-00462370, version 1—Mar. 17, 2010, 30 pages.

Moussaoui, F. et al., "The Effects of Large Vibration Amplitudes on Teh Mode Shapes and Natural Frequencies of Thin Elastic Shells, Part I: Coupled Transverse-Circumferential Mode Shapes of Isotropic Circular Cylindrical Shells of Infinite Length", Journal of Sound and Vibration (2000) 232(5), 917-943, doi:10.1006/jsvi.1999.2770, 27 pages.

Moussaoui, F. et al., "The Effects of Large Vibration Amplitudes on the Mode Shapes and Natural Frequencies of Thin Elastic Shells. Part II: A New Approach for Free Transverse Constrained Vibration of Cylindrical Shells", Journal of Sound and Vibration (2002) 255(5), 931-963, doi:10.1006/jsvi.2001.4195, 33 pages.

* cited by examiner

ARRANGEMENT AND METHOD FOR IDENTIFYING AND COMPENSATING NONLINEAR VIBRATION IN AN ELECTRO-MECHANICAL TRANSDUCER

CROSS-REFERENCE TO RELATED APPLICATIONS

This Application is a non-provisional Application of German Application No. 10 2014 005 381.4, filed Apr. 11, 2014, in German, the contents of which are hereby incorporated by reference in their entirety.

FIELD OF THE INVENTION

The invention generally relates to arrangements and methods for converting an input signal into an output signal by using an electro-mechanical transducer and for reducing nonlinear total distortion in said output signal.

BACKGROUND OF THE INVENTION

The invention generally relates to arrangements and a methods for identifying parameters of a nonlinear model, which describes the nonlinear vibration of mechanical structures, such as used in electro-mechanical and electro-acoustical transducers. This information is the basis for identifying the constructional causes of the nonlinearities, linearizing the transfer behaviors of those transducers and for compensating actively nonlinear signal distortion in an electrical, mechanical or acoustical output signal.

Loudspeakers and other electro-acoustical transducers use diaphragms, panels, shells and other mechanical structures to generate vibration and sound. At low frequencies the transducer can be modelled by a network comprising lumped elements because the major part of the sound radiating surface vibrates as a rigid body and only the suspension (e.g. spider and surround in a loudspeaker) is deformed. This model can also consider nonlinearities inherent in the mechanical suspension and motor of the transducer and is the basis for the measurement and control applications as described in the publication by Yeh, D.T., Bank, B. Karjalainen, M. entitled "Nonlinear Modeling of a Guitar Loudspeaker Cabinet" in Proceedings of 11th Int. Conference on Digital Audio Effects, pp. DAFx1-DAFx-8, September 2008 and in the patent application US 2005/0031139. The patent application US 2003/0142832 uses the nonlinear lumped parameter model to develop a recursive structure.

At higher frequencies the mechanical structure generates higher-order vibration modes which require more complex modeling using distributed parameters. The publication by Yeh, D.T. and the patent application US 2005/0175193 use linear systems (e.g. equalizers) for the simulation of the higher-order modes and the active correction of the loudspeaker's transfer behaviors at small amplitudes. However, the relationship between forces and displacement becomes nonlinear at higher amplitudes and additional spectral components (harmonic and intermodulation distortion) are generated. Those distortions impair the quality of the sound reproduced by audio devices and the performance of active noise reduction and echo cancelation.

Nonlinear vibration and the sound radiation of higher-order modes can be described by analytical or numerical models (BEM, FEM) which require detailed information on the geometry and the material used in the mechanical components.

N. Queagebeur and A. Chaigne suggest in the publication "Mechanical Resonances and Geometrical Nonlinearities in Electrodynamic Loudspeakers", Journal of Audio Eng. Soc., Vol. 56, No. 6 (2008), 462-471 the Karman model to describes the mechanical system on a higher abstraction level. This model requires the natural functions (modal shapes), natural frequencies and modal loss factor of the higher-order modes which can be determined by scanning the movement of the surface of the mechanical structure.

Generic black box models have been used for describing the nonlinear transfer behavior without considering the physical causes of the signal distortion. The document U.S. Pat. No. 6,687,235, for example, uses the Volterra expansion for echo compensation. The documents U.S. Pat. No. 5,148,427, U.S. Pat. No. 8,509,125, US2013/0216056, U.S. Pat. No. 6,813,311 and U.S. Pat. No. 5,329,586 use instead static nonlinearities without memory, which can be realized as tables, power series or nonlinear hardware components.

SUMMARY OF THE INVENTION

The invention discloses an arrangement and method for correcting the transfer behavior of an electro-mechanical or electro-acoustical transducer by improving the constructional design or by compensating the undesired signal distortion by an inverse nonlinear processing of the input or output signal. The invention is based on a physical model using distributed parameters which consider the nonlinear excitation of the higher-order modes, the influence of the time variant mode shapes on the sound radiation into the surrounding fluid (e.g. air).

The invention uses the physical information on the dominant nonlinearities to derive a block-oriented wave model which describes the generation of the nonlinear distortion and the transfer to the output signal.

The block oriented wave model distinguishes between activation modes, which activate the nonlinear behavior and affect the transfer modes, which transfer the input signal u into the output signal p. The amplitude response $|Q_m(f)|$ between the input signal u and the displacement of each mode of order m with $0<m\leq M$ has a low-pass characteristic and falls with a slope of 12 dB per octave above its natural frequency $f_m$ due to the inertia of the moved mass distributed on the diaphragm. A second mode of order k which has a lower natural frequency ($f_k<f_m$) than the first mode of order m with m>k generates usually a higher amplitude $|Q_k(f)|>|Q_m(f)|$ and activates the inherent nonlinearities to a larger extent. For this reason the fundamental and other low-order modes with $0<m\leq M_D$ which contribute significantly to the displacement are considered as the activation modes.

All modes on the diaphragm with $0<m\leq M$ may be considered as transfer modes. Higher-order modes $m\geq M_D$ with low displacement which cannot activate the nonlinearities may contribute to the generation of the sound pressure output $p(r_a)$ because the $2^{nd}$ derivative of the displacement (acceleration) determines the acoustical radiation.

The nonlinear interaction between the activation mode and transfer mode is modeled by a nonlinear processing of a modal activation signal $q_m$ representing the activation mode with a multi-modal signal $w_{m,n}$ representing the transfer modes.

The modal activation signal $q_m$ is generated by a linear activation filter $H_{e,m}$ representing at least one activation mode. The linear activation filter $H_{e,m}$ has a transfer function $Q_m(f)$ with a low-pass characteristic where the poles generate an infinite impulse response.

The modal activation signal $q_0$ representing the fundamental mode of order m=0 with the lowest natural frequency $f_0$ can be generated by using lumped parameters $P_l$ of a network model $N_l$. The series connection of the network model $N_l$ followed by a block-oriented wave model $N_d$ is an important feature of the invention.

The multi-modal signal $w_{m,n}$ is generated by using a linear multi-modal filter with the transfer function $H_{s,m,n}(s)$ representing nonlinear variation of the transfer behavior. The multi-modal filter has a broad-band transfer characteristic and considers the temporal variation of the excitation, the natural frequencies and mode shape of the transfer modes of order m with $0<m\leq M$ and their influence on sound radiation.

The nonlinear processing of the multi-modal signal $w_{m,n}$ and the modal activation signal $q_m$ can be realized by using a polynomial filter comprising quadratic, cubic and higher-order subsystem. Each power system of order n contains a static, nonlinear subsystem that generates a signal $B_{m,n}=q_m^{(n-1)}$ which is the (n−1)th-order power of the modal activation signal $q_m$. A source signal $z_{m,n}$ is generated by multiplying the signal $B_{m,n}=q_m^{(n-1)}$ with multi-modal signal $w_{m,n}$. The source signal $z_{m,n}$ describes the distortion signal at the place (e.g. surround) and in the state variable (e.g. mechanical tension) where it is generated.

The source signal $z_{m,n}$ is transferred via a following post filter with the transfer function $H_{p,m,n}(s)$ into a virtual distortion contribution $u_m$, which is added to the excitation signal $u_c$ at the transducer's input and transferred via an additional linear filter with the transfer function $H_{tot}(s)$ to the output signal $p(r_a)$.

The free parameters of the activation filter, multi-modal transfer filter and post filter give the system-oriented wave model $N_d$ the modeling capabilities to describe the influence of diaphragm's geometry and material properties, radiation condition, acoustical environment and other unknown processes. Thus the system-oriented wave model may be considered as a grey model providing sufficient degrees of freedom as other abstract, generic approaches (e.g. Volterra-system) while using structural information from physical modeling (e.g. FEM, BEM). It is a characteristic feature of the invention, that the system-oriented wave model $N_d$ comprises a minimal number of free parameters $P_d$, which are interpretable in a mechanical and acoustical context and have a high diagnostic value for the development, optimization and quality control of transducers.

All free parameters $P_d$ of the wave model $N_d$ can be determined by adaptive system identification while exciting the transducer by an ordinary audio signal (e.g. music). Electrical signals measured at the transducer terminals can be used for the identification of the modal activation filter $H_{e,0}$ of lowest order m=0 based on a network model $N_l$ with lumped parameters $P_l$. The parameter identification of the modal activation filters $H_{e,m}$ of higher order m>0 and of all multi-modal transfer filters $H_{s,m,n}$ and post filters $H_{p,m,n}$ require a mechanical or acoustical sensor.

The wave model $N_d$ can be used to synthesize signal distortions in the transducer input signal which compensate actively for the nonlinear distortion generated by the transducers and linearize the overall transfer behavior. Active distortion reduction can improve the performance of echo cancellation in telecommunication applications using the microphone signal $p(r_s)$ for the identification of the nonlinear parameters.

The linearization of the acoustical output of the transducer requires a nonlinear preprocessing of the input signal v in a control system and the generation of a control output signal u used for the excitation of the transducer. The control system proposed by the invention comprises two subsystems connected in series using a priori information provided by physical modeling. The first subsystem generates compensation distortion $v_d$ by using the structure and parameters of the wave model $N_d$ and subtracts the distortion $v_d$ from the input signal v. The difference signal $v-v_d$ is supplied to the input of the second subsystem, which generates distortion $v_l$ based on information of the network model $N_l$ and the control output signal $u=v-v_d-v_l$ by subtracting the distortion $v_l$ from the output of the first subsystem.

These and other features, benefits and technical feasibility of the present invention are characterized more by the following illustrations, detailed description and claims.

DETAILED DESCRIPTION OF THE INVENTION

Figure 1:
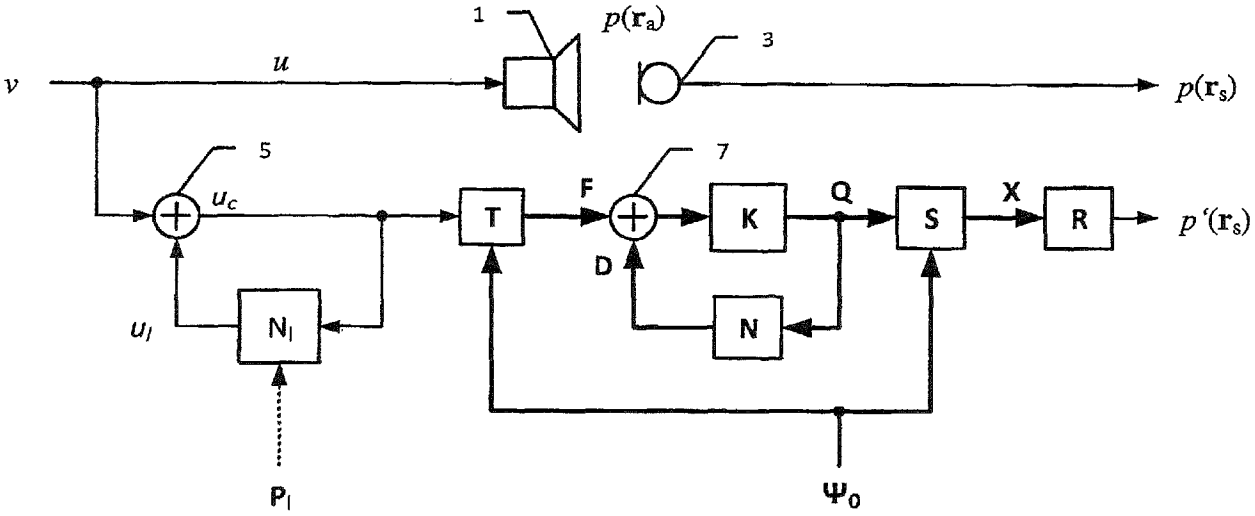
FIG. 1 shows a nonlinear model of the modal vibration and sound radiation of a transducer based on constant modal shape $\psi_0$.

FIG. 1 shows a first system model describing the transfer behavior of transducer 1 between the electrical input signal v and the sound pressure output signal $p(r_s)$ measured by an acoustical sensor 3 at measurement point $r_s$. The nonlinear network model $N_l$ describes the effect of nonlinearities inherent in the motor and in the mechanical suspension of transducer 1 by using lumped parameters $P_l$ and generates a distortion signal $u_l$. The adder 5 generates based on the input signal u and distortion signal $u_l$ the distorted input signal $u_c=u+u_l$. A modal transformation system T generates based on the distorted input signal $u_c$ the excitation forces:

$$F_m = u_c * L^{-1}\left\{\frac{Bl}{R_e + L_e s}\right\}\gamma_m(\Psi_m(r_{coil}))\ m = 0, \ldots, M \tag{1}$$

The forces summarized in vector $F=[F_0, \ldots, F_m, \ldots, F_M]$ are generated by the convolution represented by operator * of the distorted input signal $u_c$ with the inverse Laplace-transformation $L^{-1}\{\ \}$ of the rational transfer function, comprising force factor Bl, voice coil resistance $R_e$, inductance $L_e$ and Laplace operator. The excitation function $\gamma_m$ depends on the mode shapes $\psi_0=[\psi_0, \ldots, \psi_m, \ldots, \psi_m]$ at point $r_{coil}$, where the voice coil excites the diaphragm to mechanical vibration.

The displacement x(r,t) at any point r on the diaphragm is described by a modal expansion $$x(r, t) = \sum_{m=0}^{M} \Psi_m(r) q_m(t) \tag{2}$$

using the modal shapes in vector $\psi_0$ and the modal displacements in vector $Q=[(q_0, \ldots, q_m, \ldots, q_M]$. The mode shapes $\psi_0$ are according to the state of the art (see Quaegebeur) independent of the modal displacements Q.

An adder 7 generates based on excitation F and the modal distortion forces $D=[D_0, \ldots, D_m, \ldots, D_M]$ the total forces which are transformed via a linear transfer element K into the modal displacement $$q_m=(F_m+D_m(Q))*L^{-1}\{K_m(s)\}m=0, \ldots, M \tag{3}$$

by convoluting the total forces F+D with the impulse response of the modal transfer function $$K_m(s) = \frac{1}{1 + \eta_m \frac{s}{\omega_m} + \left(\frac{s}{\omega_m}\right)^2} G_{in}(s) \tag{4}$$

using the inverse Laplace transform.

The modal transfer function $K_m(s)$ describes the linear dynamics of the vibration modes with the modal loss factor $\eta_m$ and natural frequency $\omega_m$. The additional transfer function $G_{in}(s)$ considers the influence of a coupled mechanical or acoustical systems. A vent in a loudspeaker enclosure, for example, generates at the acoustical Helmholtz resonance frequency $f_p$ a null in the transfer function $G_{in}(s)$, without changing the mode shapes in $\psi_0$.

The nonlinear distortion forces $$D_m(Q) = \sum_{i=0}^{M}\sum_{j=0}^{M} a_{m,i,j} q_i q_j + \sum_{i=0}^{M}\sum_{j=0}^{M}\sum_{k=0}^{M} a_{m,i,j,k} q_i q_j q_k + \ldots \tag{5}$$

are expanded by the static nonlinear system N into a power series of modal displacements $q_i$ from vector Q. The coefficients $a_{m,i,j}, \ldots$ represent the nonlinear bending stiffness of the diaphragm.

The inverse modal transformation S generates based on the modal displacements Q and mode shapes $\psi_0$ according to Eq. (2) the displacements $X=[x(r_1), \ldots, x(r_k), \ldots, x(r_K)]$ at any point on the sound radiating surface. The following radiation system R generates based on the displacements X the sound pressure $p'(r_a,t)$ at the observation point $r_a$ by using the Rayleigh integral $$p'(r_a, t) = \frac{\rho_0}{2\pi}\int_{S_e} x(r, t) * L^{-1}\{s^2 G(s, r_a \mid r)\} dS_c \tag{6}$$

with the Green's function $$G(s, r_a \mid r) = \frac{\exp(|r - r_a| s/c_0)}{|r - r_a|}, \tag{7}$$

density of air $\rho_0$ and the sound radiating surface $S_c$.

Figure 2:
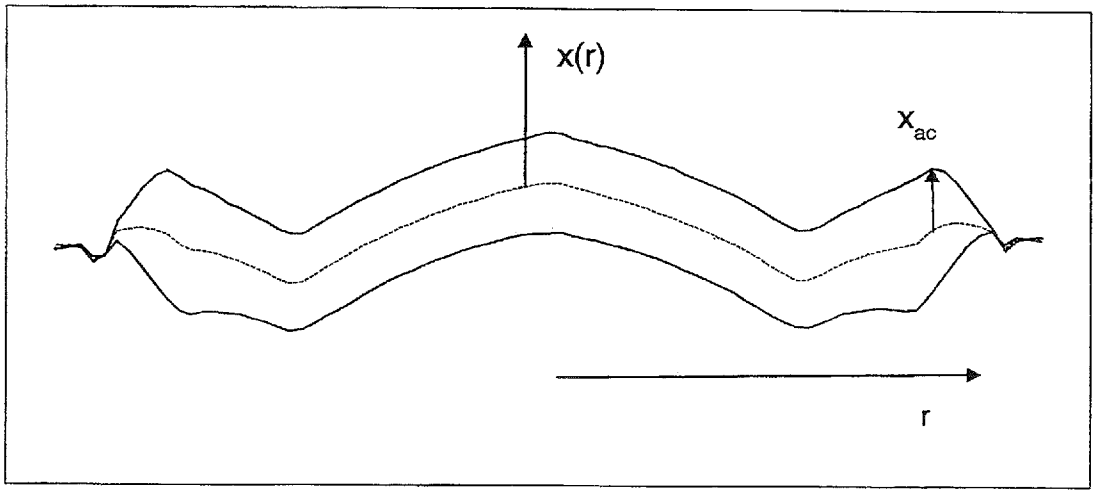
FIG. 2 shows the geometry (dashed line) at rest position and the maximum positive and negative displacement (solid lines) of the diaphragm for a sinusoidal excitation at 10 kHz.

FIG. 2 shows, for example, the geometry of a diaphragm used in headphones as a dashed line and the positive and negative maximum displacement $x_{ac}$, for a sinusoidal excitation at 10 kHz.

Figure 3:
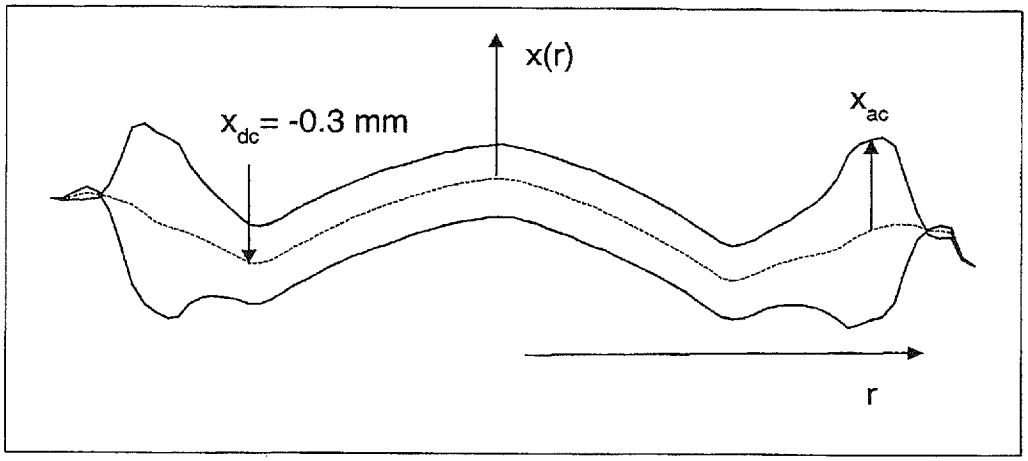
FIG. 3 shows the geometry (dashed line) of the diaphragm by generating −0.3 mm negative DC displacement of the voice coil and the maximum positive and negative displacement (solid lines) of the diaphragm for a sinusoidal excitation at 10 kHz.

FIG. 3 shows the influence of a negative DC signal $x_{dc}=-0.3$ mm on the mode shape at 10 kHz. The DC signal represents a low frequency tone (bass tone) generating high displacement in the fundamental mode m=0 which effects the mode shape $\psi_m$ of the higher-order modes (m≥0) and generates the vibration at the outer region of the diaphragm.

Figure 4:
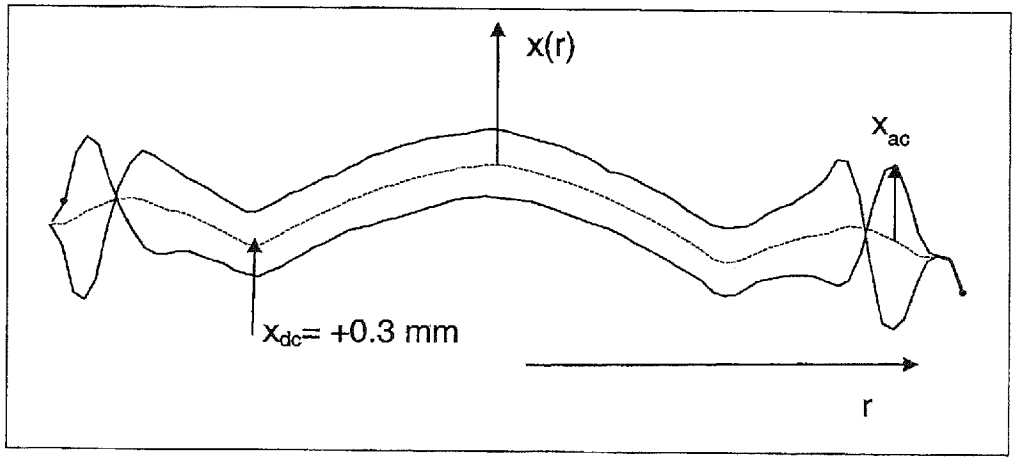
FIG. 4 shows the geometry (dashed line) of the diaphragm by generating 0.3 mm positive DC displacement of the voice coil and the maximum positive and negative displacement (solid lines) of the diaphragm for a sinusoidal excitation at 10 kHz.

FIG. 4 shows the influence of a positive DC signal $x_{dc}=0.3$ mm generating nodes in the mode shape dividing the diaphragm into an inner and outer region which are vibrating in anti-phase. The Rayleigh integral in Eq. (6) accumulates destructively the positive and negative volume velocities generating a reduced acoustical output compared to the modal shape depicted in FIG. 3. The nonlinear dependency of the mode shapes ψ(Q) on the modal displacements Q may be also described by the effective radiation area defined as $$S_D(s) = \frac{\int_{S_c} X(s, r) dS_c}{\overline{X_{coil}}(s)}, \tag{8}$$

using the mean voice coil displacement $$\overline{X_{coil}}(s) = \frac{\int_{r_{coil}} X(s, r) dr}{\int_{r_{coil}} dr}. \tag{9}$$

Figure 5:
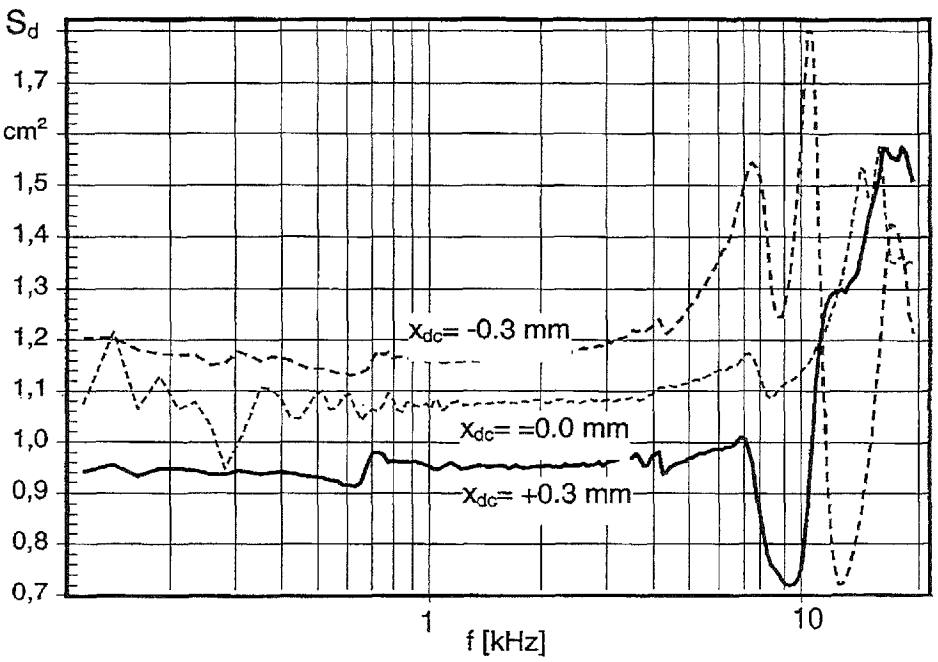
FIG. 5 shows the variation of the effective radiation area $S_d(x_{dc})$ as a function of the static displacement $x_{dc}$ of the voice coil.

FIG. 5 shows the effective radiation area $S_d(x_{dc},f)$ of the headphone diaphragm as a function of the static displacement $x_d$, generated by the DC signal and the frequency f of the AC excitation tone. The effective radiation area $S_d(x_{dc},f)$ decreases 30% by shifting the voice coil in positive direction and increases more than 50% in negative direction at 10 kHz. Below 5 kHz the varying DC signal generates about 10% variation of the effective radiation area $S_d(x_{dc},f)$.

Figure 6:
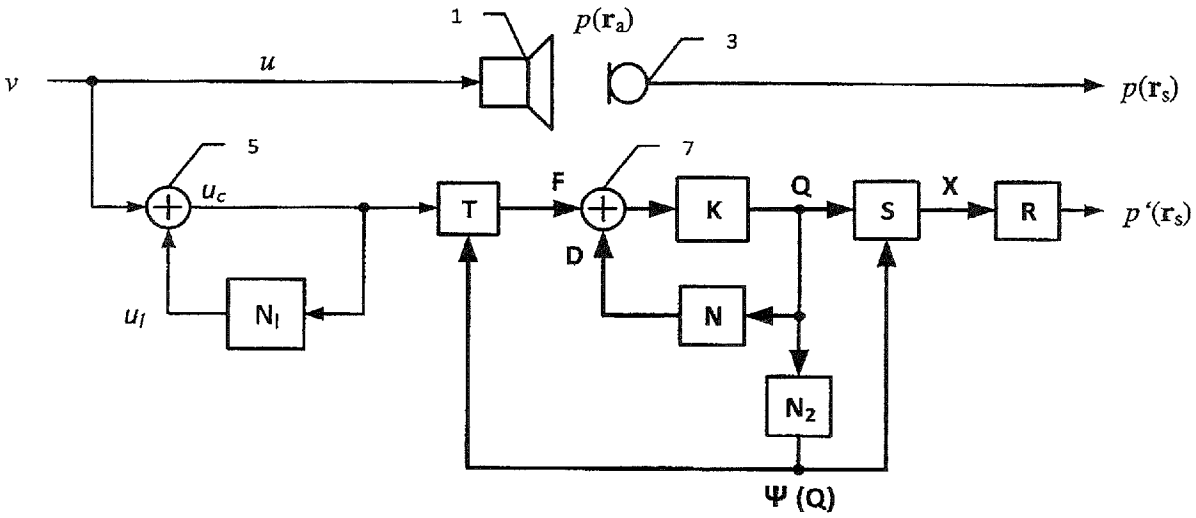
FIG. 6 shows a nonlinear model of the modal vibration and sound radiation of a transducer considering the change of the modal shape $\psi(Q)$.

FIG. 6 shows an extended model of the transducer in accordance with the invention by using the modal expansion $$x(r, t) = \sum_{m=0}^{M} \Psi_m(r, Q) q_m(t) \tag{10}$$

which considers the nonlinear dependency of the mode shapes ψ(r, Q) on the displacements Q in a static nonlinear system $N_2$ which can be described as a power series:

$$\Psi_m(r, Q) = \Psi_m(r, 0)\left(1 + \sum_{i=0}^{M} b_{m,i}(r) q_i + \sum_{i=0}^{M}\sum_{j=0}^{M} b_{m,i,j}(r) q_i q_j + \ldots\right) \tag{11}$$

The time varying mode shapes ψ(r, Q) are used in modal transformation T generating the excitation forces $$F_m = u_c * L^{-1}\left\{\frac{Bl}{R_e + L_e s}\right\}\gamma_m(\Psi_m(r_{coil}, Q))\ m = 0, \ldots, M, \tag{12}$$

by using the series expansion $$\gamma_m(\Psi_m(r_{coil}, Q)) = \gamma_m \Psi(\Phi_m(r_{coil}, 0))\left(1 + \sum_{i=0}^{M} c_{m,i}(r) q_i + \sum_{i=0}^{M}\sum_{j=0}^{M} c_{m,i,j}(r) q_i q_j + \ldots\right) \tag{13}$$

of the modal displacements Q.

The extended model in FIG. 6 has a high complexity and a large number of free parameters $a_{m,i,j}, \ldots, b_{m,i}, \ldots$ and $c_{m,i}, \ldots$, which have to be identified for the particular transducer at sufficient accuracy. The computational effort can be significantly reduced by applying a useful approximation to the power series in Eqs. (5), (11) and (13) and neglecting cross terms of the modal displacements $q_i$ which do not contribute significantly to the total distortion.

Figure 7:
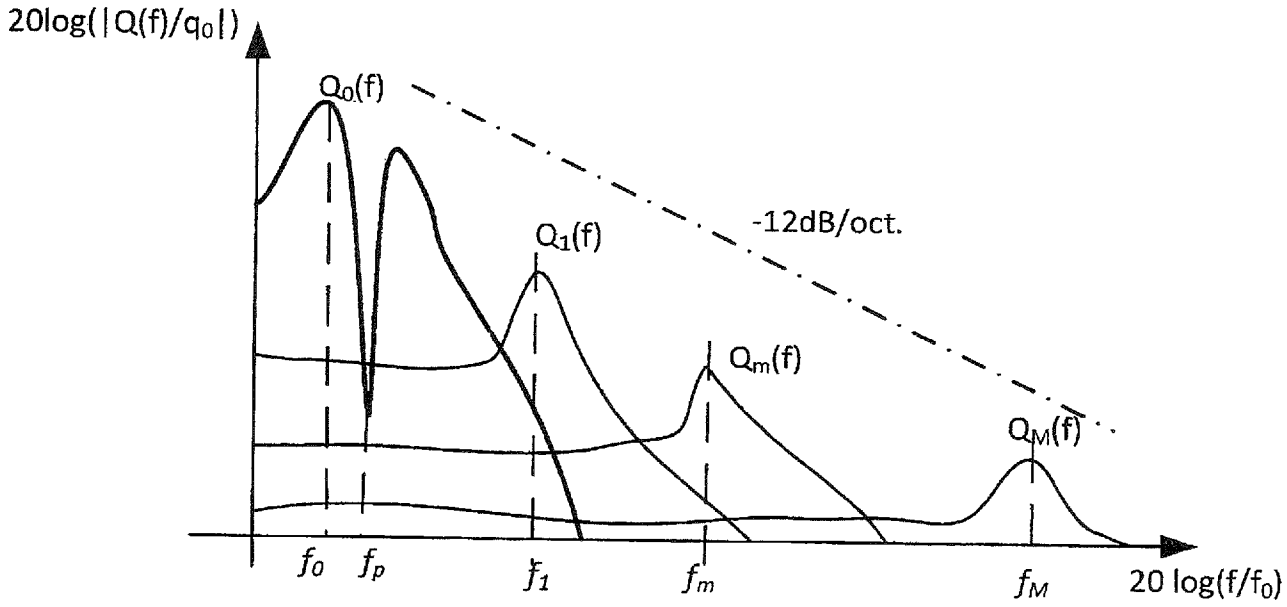
FIG. 7 shows the amplitude response of the modal displacement versus frequency.

According to Eq. (4) all modes have a low-pass characteristic generating the amplitude response $|Q_m(f)|$ of the modal displacement of order m=0, 1, . . . as shown in FIG. 7. The fundamental mode (m=0) with the lowest natural frequency $f_0$ generates the largest displacement $q_0$ besides the acoustical resonance frequency $f_p$ where the vented box enclosure causes a null in the transfer function. The higher-order modes (m>0) generate at the natural frequency $f_m$ the highest amplitude due to the low losses usually found in diaphragm materials. At all other frequencies the amplitude $|Q_m(f)|$ of the higher-order modes is smaller than the amplitude $|Q_k(f)|$ generated by lower-order modes (with k<m) below the natural frequency $f \le f_k$ giving the following relationship between the nonlinear terms in the power expansion:

$$|Q_m(f_m)|^n > |Q_k(f_k)|^n > |Q_m(f_m)|^{n-i}|Q_k(f_k)|^i m<k, i = 1, \ldots, n-1 \tag{14}$$

This relationship can be used to select the dominant nonlinear terms in Eqs. (5), (11) and (13) and generating a useful approximation for the distortion forces $$D_m(Q) \approx q_m \sum_{i=0}^{M_D} (a_{m,m,i} q_i + a_{m,m,i,i} q_i^2 + \ldots) \tag{15}$$

-continued $$= q_m \sum_{i=0}^{M_D}\sum_{n=2}^{N} \alpha_{m,i,n} q_i^{n-1}$$

the nonlinear variation of the mode shape $$\Psi_m(r, Q) \approx \Psi_m(r, 0)\left(1 + \sum_{i=0}^{M_D} (b_{m,i}(r) q_i + b_{m,i,i}(r) q_i^2 + \ldots)\right) = \Psi_m(r, 0)\left(1 + \sum_{i=0}^{M_D}\sum_{n=2}^{N} \beta_{m,i,n}(r) q_i^{n-1}\right) \tag{16}$$

and the nonlinear excitation function $$\gamma_m(\Psi_m(r_{coil}, Q)) \approx \gamma_m(\Psi_m(r_{coil}, 0))\left(1 + \sum_{i=0}^{M_D}\sum_{n=2}^{N} \chi_{m,i,n}(r) q_i^{n-1}\right). \tag{17}$$

The Eqs. (15), (16) and (17) reveal a nonlinear interaction between modes of different order generating intermodulation distortion between low and high frequency components. In practice the displacement $q_0$ of the fundamental mode (m=0) with the lowest natural frequency $f_0$ activates the dominant nonlinearities of the wave model $N_d$.

Figure 8:
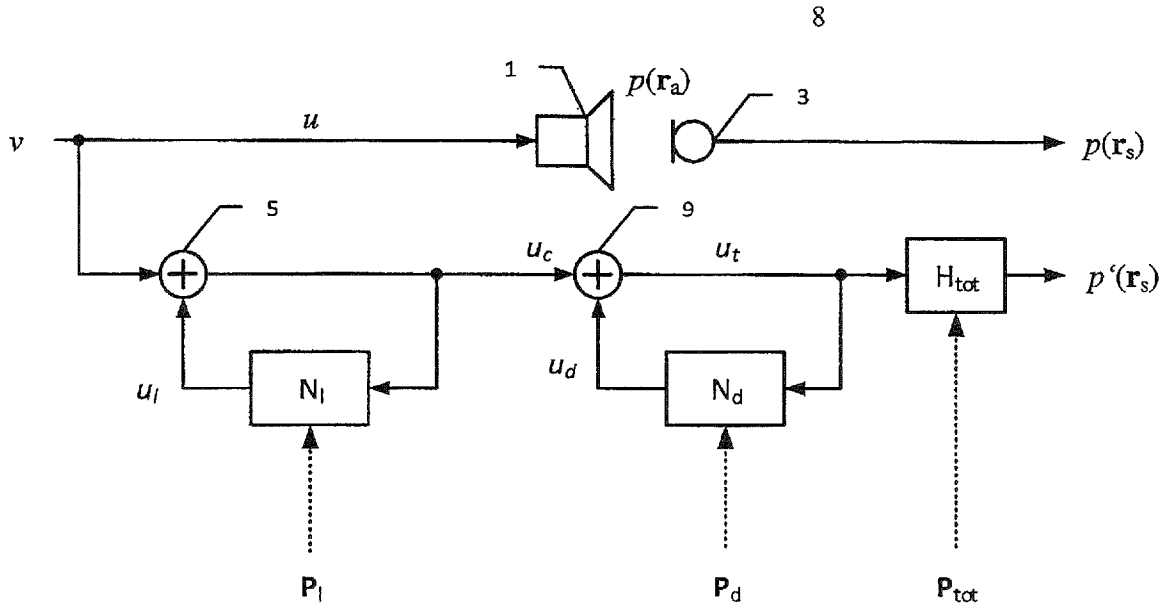
FIG. 8 shows a nonlinear system modeling the modal vibration and sound radiation of the transducer by using equivalent input distortion $u_l$ and $u_d$.

FIG. 8 shows a nonlinear model of the mechanical vibration and sound radiation by using a system oriented approach where the nonlinear distortion generated in the mechanical and acoustical domain are transformed into an equivalent input distortion signal $u_d$ which is combined with the output signal $u_c$ output of network model $N_l$ by adder 9. The total signal $u_c+u_d$ is transferred via a linear filter with the transfer function $H_{tot}(s)$ into the acoustical output signal:

$$p'(t, r_a) = u_t * L^{-1}\{H_{tot}(s)\} = (u_c + u_d) * L^{-1}\{H_{tot}(s)\} \tag{18}$$

Figure 9:
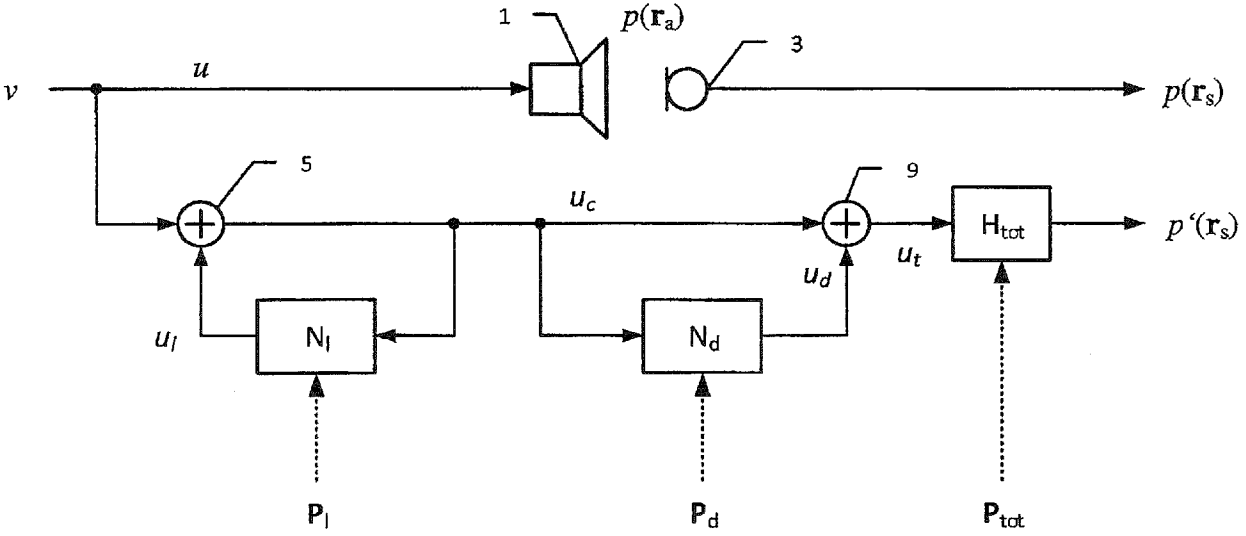
FIG. 9 shows a modified nonlinear model system modeling the modal vibration and sound radiation of the transducer by using equivalent input distortion $u_l$ and $u_d$.

FIG. 9 shows an alternative embodiment of the invention. Contrary to FIG. 8, the input of the nonlinear system $N_d$ is not supplied with the total signal $u_t$ from the output of adder 9 but receives the input signal $u_c$. This feed-forward approximation simplifies the realization with adaptive FIR filters which are stable for all values of the filter parameters.

Figure 10:
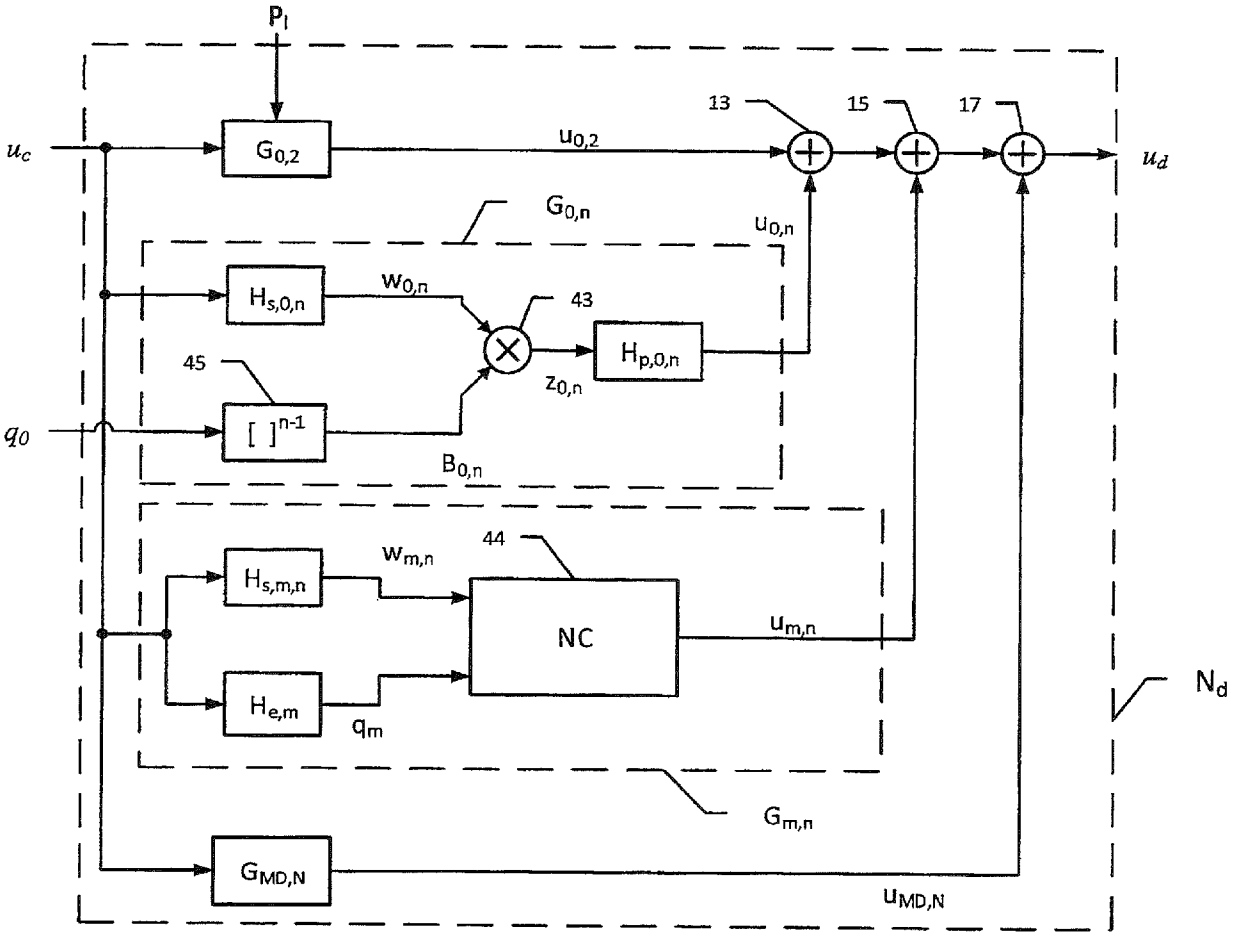
FIG. 10 shows an embodiment of the nonlinear System $N_d$ generating the nonlinear equivalent input distortion $u_d$.

FIG. 10 shows an embodiment of the nonlinear systems $N_D$, which generates the multi-modal distortion signal $u_d$. This system comprises a multitude of nonlinear subsystems $G_{m,n}$ with m=0, . . . , $M_D$ and n=2, . . . , N connected in parallel, each generating based on the input signal $u_c$ a distortion contribution $$u_{m,n} = ((L^{-1}\{H_{e,m}(s)\} * u_c)^{n-1}(L^{-1}\{H_{s,m,n}(s)\} * u_c)) * L^{-1}\{H_{p,m,n}(s)\} \tag{19}$$

summarized by adders 13, 15, 17 to the multi-modal distortion:

$$u_d = \sum_{m=0}^{M_D}\sum_{n=2}^{N} u_{m,n} \tag{20}$$

The subsystem $G_{m,n}$ comprises a linear modal activation filter $H_{e,m}$ generating based on input signal $u_c$ a modal activation signal $q_m$, describing the state of at least one dominant mechanical vibration mode. The modal activation filter $H_{e,m}$ has poles in the rational transfer function $H_{e,m}(s)$ and generates an infinite impulse response, like a recursive IIR-Filter. A linear multi-modal transfer filter $H_{s,m,n}$ generates based on input signal $u_c$ a multi-modal signal $w_{m,n}$, which represents the effect of the all mechanical modes ($0 \le m \le M$) on the mechanical vibration and the sound radiation at the surface $S_c$. Thus, the multi-modal signal $w_{m,n}$ describes the transfer of the linear audio signal by the mechanical and acoustical system and the scaling with nonlinear coefficients $a_{m,i,n}$, $\beta_{m,i,n}$ and $\chi_{m,i,n}$ in the power series expansion in Eqs. (15), (16) and (17). The Rayleigh integral in Eq. (6) may generate nulls in the linear multi-modal transfer filter $H_{s,m,n}$ and can be embodied by an FIR-filter.

The connection element 44 combines the multi-modal signal $w_{m,n}$ with the modal activation signal $q_m$ based on a nonlinear transfer function and generates the distortion contribution $u_{m,n}$.

The subsystem $G_{0,2}$ in FIG. 10 has a similar structure as the subsystem $G_{m,n}$, but uses the lumped parameters $P_l$ provided by nonlinear network model $N_l$ in FIG. 1 to generate the modal activation signal $q_m$ based on the input signal $u_c$ in the first modal activation filter $H_{e,0}$ with the transfer function:

$$H_{e,0}(s) = K_0(s)\frac{Bl}{R_e + L_e s} \tag{21}$$

The subsystem $G_{0,n}$ in FIG. 10 shows a further embodiment, which dispenses with the first linear Filter $H_{e,0}$ but receives the modal activation signal $q_m$ directly from the network model or from another external source. The static nonlinearity 45, the multiplier 43 and the post filter $H_{p,0,n}$ are an embodiment of the connection element 44.

The multi-modal transfer functions of the quadratic subsystem (m=0, n=2)

$$H_{s,0,2}(s) = \frac{S_D(s, x_{dc}) - S_D(s, -x_{dc})}{2x_{dc}S_D(s, 0)} \tag{22}$$

and of the cubic subsystem (m=0, n=3)

$$H_{s,0,3}(s) = \frac{S_D(s, x_{dc}) + S_D(s, -x_{dc}) - 2S_D(s, 0)}{x_{dc}^2 S_D(s, 0)} \tag{23}$$

can be calculated by using the effective radiation area $S_d(x_{dc})$ of the headphone diaphragm as shown in FIG. 5 based on the assumption that the transfer function of the post filter $$H_{p,0,n}(s)=1 n=2,3 \tag{24}$$

is assumed as constant over frequency.

The linear parameters $P_{tot}$ describe the total transfer function $H_{tot}(s)$ $$H_{tot}(s) = \frac{\rho_0}{2\pi}\frac{\overline{X_{coil}}(s)}{U(s)}s^2 S_D(s, 0)G(s, r_a \mid r_{coil}), \tag{25}$$

using the effective radiation area $S_D(s,0)$ at the rest position $x_{dc}=0$, the linear lumped parameters $P_l$ of the network model and the Green's function G.

Figure 11:
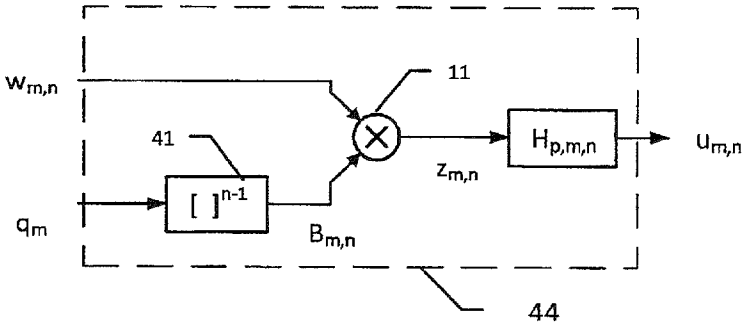
FIG. 11 shows an embodiment of the nonlinear connection element generating a distortion contribution $u_{m,n}$.

FIG. 11 shows an embodiment of the connection element 44. A static nonlinearity 41 sets the modal activation signal $q_m$ to the (n−1)th power. The output signal $B_{m,n}=q_m^{(n-1)}$ is combined with the multi-modal signal $w_{m,n}$ in multiplier 11 and the generated source signal $z_{m,n}$ is transferred via a post filter $H_{p,m,n}$ into the distortion contribution $u_{m,n}$. The post filter considers the position of the nonlinear distortion source on the diaphragm, the local excitation point of the modal vibration and the radiation condition and distance $|r-r_a|$ in the Green's function in Eq. (7).

Figure 12:
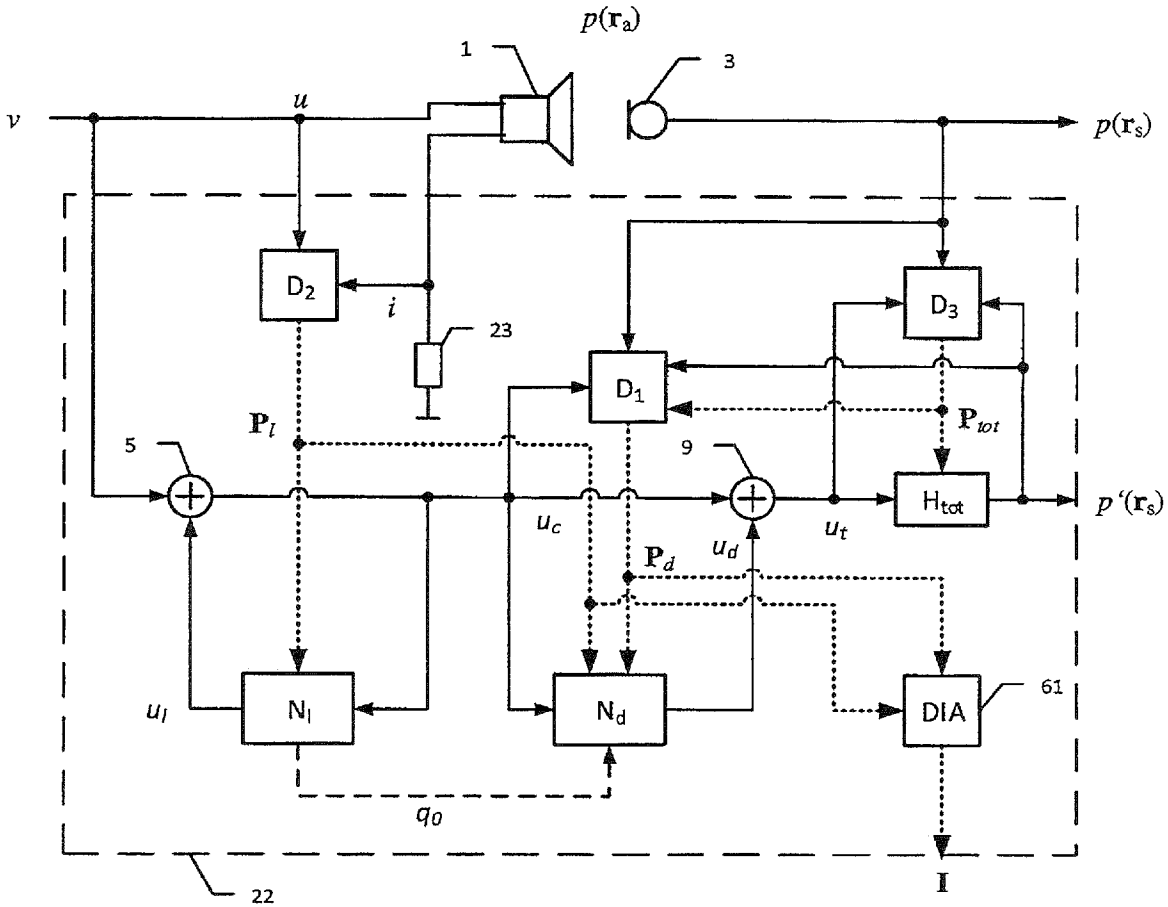
FIG. 12 shows an embodiment of the invention to identify the parameters $P_l$, $P_d$ and $P_{tot}$.

FIG. 12 shows an embodiment of the invention used for the identification of the free model parameters $P_l$, $P_d$ and $P_{tot}$. The lumped parameters $P_l$ are determined by a second parameter detector $D_2$ based on the terminal voltage u and input current i of transducer 1 measured by using a current sensor 23. The lumped parameters $P_l$ are supplied to the nonlinear network model $N_l$, to the wave model $N_d$ and to a diagnostic system 61.

The distributed parameters $P_d$ are generated in a first parameter detector $D_1$ by using a sensor signal $p(r_s)$ provided by an acoustical or mechanical sensor 3, the estimated signal $p'(r_s)$ generated at the output of the linear filter $H_{tot}$ and the electrical output signal $u_c$ of adder 5. The first parameter detector $D_1$ may be embodied as an adaptive system, identifying the coefficients of the linear FIR-filter $H_{s,0,n}$ and $H_{p,m,n}$ in the wave model $N_d$ as disclosed in the patent application GB 2308898. The unique identification of the poles in the IIR filters $H_{e,m}$ with m=0, . . . , $M_d$−1 requires a constraint on the natural frequencies $f_m<f_{m+1}$ represented by each IIR filter. The wave model $N_d$ may use a state signal $q_0$ generated by network model $N_l$ describing the mechanical mode m=0 with the lowest natural frequency $f_0$.

The linear parameters $P_{tot}$ of the linear total system $H_{tot}$ are determined by the third parameter detector $D_3$ based on the sensor signal $p(r_s)$, the estimated signal $p'(r_s)$ and the total signal $u_t$. The diagnostic system 61 generates information I, which simplify the interpretation of the model parameters $P_l$ and $P_d$ and reveal the physical root cause of the signal distortion generated by transducer 1. For example, the nonlinear dependency of the effective radiation area $S_D(f, x_{dc})$ on frequency f and DC displacement $x_{dc}$ can be calculated based on the transfer functions $H_{s,0,2}(s)$ and $H_{s,0,3}(s)$ in accordance with Eqs. (22) and (23).

Figure 13:
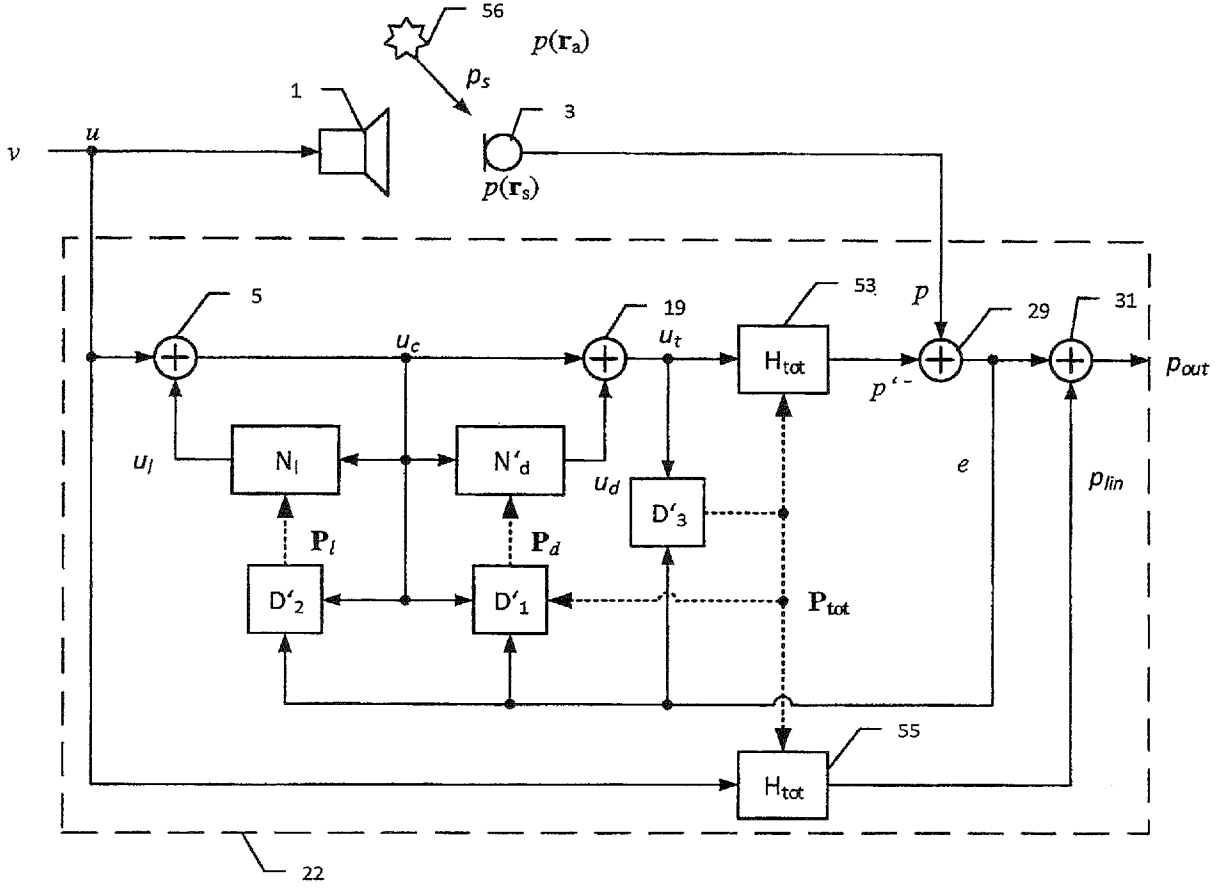
FIG. 13 shows a first embodiment of the invention to linearize the measured signal $p_{out}$.

FIG. 13 shows a first embodiment of the active distortion compensation in the measured sound pressure signal $p(r_s)$ generating a linearized output signal $p_{out}$. This arrangement uses a subtraction element 29 to generate an error signal $e=p(r_s)-p'(r_s)$ as the difference between the measured and the modelled sensor signal. This parameter detectors $D'_1$, $D'_2$ and $D'_3$ generate adaptively optimal estimates of parameters $P_l$, $P_d$ and $P_{tot}$ by minimizing the error signal e. After convergence of the adaptive process the error signal e contains the external signal $p_s$ generated by an additional signal source 56, measurement noise and other disturbances, which cannot be compensated by the model. A linear model system 55 having the same transfer function $H_{tot}(s)$ as the linear model 53 generates based on linear parameters $P_{tot}$ a linear output signal $p_{lin}$. An adder 31 generates based on linear signal $P_{lin}$ and error signal e the linearized output signal $p_{out}$. The error signal $e(t)\approx p_s(t)$ and the linearized output signal $p_{out}(t)$ may be used for echo compensation in telecommunication and other applications.

Figure 14:
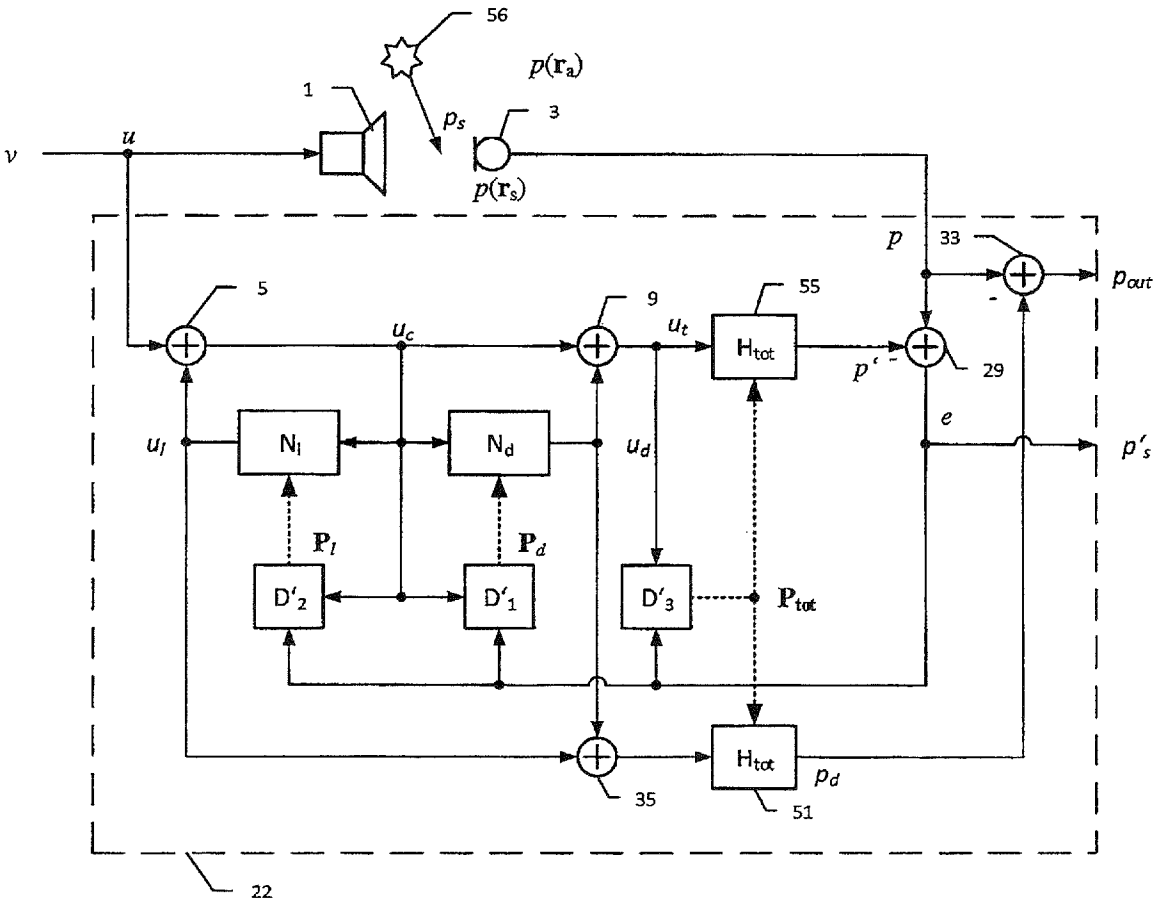
FIG. 14 shows a second embodiment of the invention to linearize the measured signal $p_{out}$.

FIG. 14 shows an alternative embodiment of the active distortion compensation of the linearized output signal $p_{out}$.

The distortion signals $u_l$ and $u_d$ at the outputs of the network model $N_l$ and wave model $N_d$, respectively, are added by element 35 and transferred via a linear filter 51 with transfer function $H_{tot}(s)$ into the total distortion $p_d$. A subtraction element 33 generates the linearized output signal $p_{out}(r_s)=p(r_s)-p_d$ based on the sensor signal $p(r_s)$ and the total distortion $p_d$.

Figure 15:
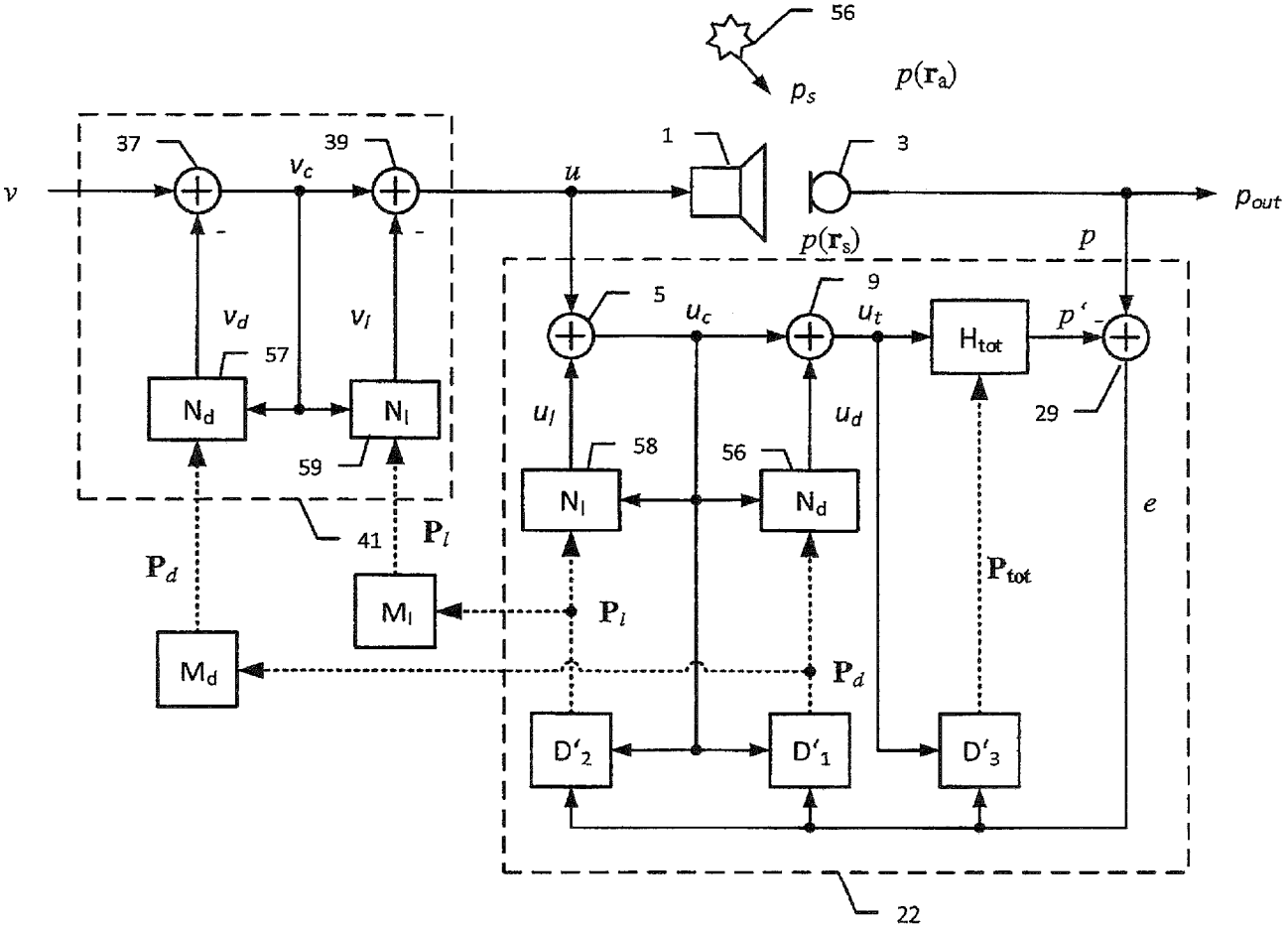
FIG. 15 shows an embodiment of the invention to linearize the transducer output signal $p(r_a)$.

FIG. 15 shows an embodiment of the inverse preprocessing of des input signal v and the generation of a pre-distorted excitation signal $u=v-v_d-v_l$ based on distributed parameters $P_d$ and the lumped parameters $P_l$ in accordance with the invention. The control system 41 comprises a first nonlinear synthesis element 59, corresponding to the network model $N_l$ and the lumped parameters $P_l$ used in the nonlinear element 58 of the adaptive identification system 22. The state variables $v_c$ and $u_c$ at the input of elements 59 and 58, respectively, are identical because the distortion signals $u_l$ and $v_l$ are compensated by the subtraction element 39 and adder 5.

The control system 41 contains a second nonlinear synthesis system 57, corresponding to the wave model $N_d$ and the distributed parameters $P_d$ used in nonlinear system 56 of the identification system 22 as shown in FIG. 10. Since the synthesized distortion signal $v_d$ equals the modelled distortion signal $u_d$, both distortions are cancelled by the subtraction element 37 and adder 9 and the input signal v corresponds to the total signal $u_t$ and a linear transfer behavior is generated between input signal v and the sound pressure $p(r_a)$ at an arbitrary observation point $r_a$ in the sound field.

The lumped parameters $P_l$ and the distributed parameters $P_d$ are valid for an arbitrary input signal v for limited period of time. Thus the identification system 22 may be temporarily deactivated and the control system 41 may be provided by parameters $P_d$ and $P_l$ stored in the memory elements $M_d$ and $M_l$, respectively. However, the identification system 22 has to be activated for generating initial starting values for the parameters $P_l$ and $P_d$ and compensating aging, fatigue in transducer (1) and other external influences.

ADVANTAGES OF THE INVENTION

The invention uses physical modeling to develop a general model which requires no detailed information on the design of the transducers, in particular the shape and the properties of the material used in the diaphragm or other mechanical structures generating vibration or sound. Limiting the maximum order N of the power series expansion and the maximum order $M_D$ of vibration modes the model can be used to compensate dominant nonlinearities only and to achieve sufficient performance in the distortion reduction at low processing load and cost.

The arrangements and methods used for parameter identification and distortion reduction behave stable under all conditions and provide valuable information about the transducer parameters and internal state variables, which can be used for root cause analysis of signal distortion and further optimization of the transducer design.

Contrary to the known physical models as proposed by Queagebeur there is no need for a scanning sensor to measure the modal shape of mechanical vibration or sound pressure distribution. The mechanical or acoustical sensor already required for active echo compensation, active vibrations- and noise control can also be used for the current invention reducing the cost for additional hardware components.

The invention can be implemented in available microprocessors or digital signal processors (DSP) at low memory requirements and processing load. The lumped parameters $P_l$ and distributed parameters $P_d$ can be identified adaptively while exciting the transducer with an arbitrary audio signal (e.g. music). The adaptive identification system 22 can be deactivated temporarily, if the transducer and other hardware components behave sufficiently time invariant during this period.

The invention claimed is:

1. Arrangement for converting an electrical input signal v into a mechanical or an acoustical output signal $p(r_a)$ by using an electro-mechanical transducer and for reducing nonlinear total distortion $p_d$ in said output signal $p(r_a)$, whereas the nonlinear total distortion $p_d$ contains multi-modal distortions $u_d$ which are generated by nonlinear partial vibration of mechanical transducer components, the arrangement comprising:

a sensor which is configured and arranged such to measure a mechanical or an acoustical state variable ($p(r_s)$) of said transducer and to generate a measurement signal p that represents state variable;

a first parameter detector ($D_1$; $D'_1$) which is configured and arranged such to generate based on said measurement signal p distributed parameters $P_d$, whereas the distributed parameters $P_d$ contain modal information $H_{e,m}(s)$ of at least one activation mode, which activates the nonlinear partial vibration of the mechanical component;

the distributed parameters $P_d$ contain multi-modal information $H_{s,m,n}(s)$, which represent the properties of the transfer modes generating the output signal $p(r_a)$;

a nonlinear wave model, which is configured and arranged such to generate based on said input signal v and said distributed parameters $P_d$ multi-modal distortion $u_d$, whereas the nonlinear wave model comprises an activation filter ($H_{e,m}$) which is configured and arranged such to generate based on the modal information $H_{e,m}(s)$ a modal activation signal $q_m$, which represents the vibration state of said activation mode; said activation filter ($H_{e,m}$) comprises a linear transfer behavior with a low-pass characteristic, whereas the low-pass characteristic is determined by said modal information $H_{e,m}(s)$;

a transfer filter ($H_{s,m,n}$) which is configured and arranged such to generate based on the multi-modal information $H_{s,m,n}(s)$ a multi-modal signal $w_{m,n}$, which represents the nonlinear relationship between the modal activation signal $q_m$ and the multi-modal distortion $u_d$; the transfer filter ($H_{s,m,n}$) comprises linear transfer behavior with a high-pass characteristic, whereas the high-pass characteristic is determined by said multi-modal information $H_{s,m,n}(s)$;

a nonlinear connection element which is configured and arranged such to combine the modal activation signal $q_m$ and multi-modal signal $w_{m,n}$ and to generate a distortion contribution $u_{m,n}$ for said multi-modal distortion $u_d$, and a diagnostic system generating information about the root cause of the multi-modal distortion $u_d$ based on said distributed parameters $P_d$;

and said nonlinear connection element comprises a homogenous nonlinear power system, which is configured and arranged such to set said modal activation signal $q_m$ to the power with the exponent n−1 and to generate a powered signal $B_{m,n}=q_m^{n-1}$;

a multiplicator, which is configured and arranged such to generate a nonlinear source signal $z_{m,n}$ based on a multiplication of the powered signal $B_{m,n}$ with said multi-modal signal $w_{m,n}$.

2. Arrangement for converting an electrical input signal v into a mechanical or an acoustical output signal $p(r_a)$ by using an electro-mechanical transducer and for reducing nonlinear total distortion $p_d$ in said output signal $p(r_a)$, whereas the nonlinear total distortion $p_d$ contains multi-modal distortions $u_d$ which are generated by nonlinear partial vibration of mechanical transducer components, the arrangement comprising:

a multi-modal synthesizing element which is configured and arranged such to generate based on the input signal v a multi-modal compensation signal $v_d$ by using a nonlinear wave model ($N_d$) and distributed parameters $P_d$, whereas the multi-modal compensation signal $v_d$ represents the multi-modal distortion $u_d$;

said distributed parameters $P_d$ comprise modal information $H_{e,m}(s)$ of at least one activation mode, which activates the nonlinear partial vibration of the mechanical component;

the distributed parameters $P_d$ comprise multi-modal information $H_{s,m,n}(s)$ which represent the properties of transfer modesgenerating the output signal $p(r_a)$;

the wave model comprises at least one activation filter ($H_{e,m}$), which is configured and arranged such to generate based on the modal information $H_{e,m}(s)$ a modal activation signal $q_m$, which represents the vibration state of said activation mode; said activation filter ($H_{e,m}$) comprises a linear transfer behavior with a low-pass characteristic, whereas the low-pass characteristic is determined by said modal information $H_{e,m}(s)$;

the wave model comprises at least one transfer filter ($H_{s,m,n}$), which is configured and arranged such to generate based on the multi-modal information $H_{s,m,n}(s)$ a multi-modal signal $w_{m,n}$, which represents the nonlinear relationship between the modal activation signal $q_m$ and the multi-modal distortion $u_d$; the transfer filter ($H_{s,m,n}$) comprises linear transfer behavior with a high-pass characteristic, whereas the high-pass characteristic is determined by said multi-modal information $H_{s,m,n}(s)$;

the wave model comprises at least one nonlinear connection element which is configured and arranged such to combine the modal activation signal $q_m$ and multi-modal signal $w_{m,n}$ and to generate a distortion contribution $u_{m,n}$ for the multi-modal compensation signal $v_d$; and a first subtraction element which is configured and arranged such to generate a control signal $v_c$ based on the difference of said input signal v and said multi-modal compensation signal $v_d$ and to supply the generated control signal $v_c$ to the transducer and said nonlinear connection element comprises a homogenous nonlinear power system, which is configured and arranged such to set said modal activation signal $q_m$ to the power with the exponent n−1 and to generate a powered signal $B_{m,n}=q_m^{n-1}$; and a multiplicator, which is configured and arranged such to generate a nonlinear source signal $z_{m,n}$ based on a multiplication of the powered signal $B_{m,n}$ with said multi-modal signal $w_{m,n}$.

3. Arrangement according to claim 1, whereas said nonlinear connection element comprises a linear post filter ($H_{p,m,n}$), which is configured and arranged such to transfer the nonlinear source signal $z_{m,n}$ into a distortion contribution $u_{m,n}$, whereas the distributed parameters $P_d$ determine the transfer function $H_{p,m,n}(s)$ of the linear post filter ($H_{p,m,n}$).

4. Arrangement according to claim 1, further comprising:

at least one adding device, which is configured and arranged such to generate a total signal $u_t$ by combining said excitation signal u with said multi-modal distortion $u_d$;

a third parameter detector ($D_3$, $D'_3$), which is configured and arranged such to generate based on said measurement signal p linear parameters $P_{tot}$, whereas the linear parameters $P_{tot}$ represent the relationship between said total signal $u_t$ and said measurement signal p; and a total transfer element, which is configured and arranged such to generate based on said linear parameters $P_{tot}$ and said total signal $u_t$ an estimate p' of said measurement signal p;

subtraction element, which is configured and arranged such to generate an error signal e=p−p' that represents the deviation between said measurement signal p and said estimate p'; whereas said first parameter detector ($D_1$, $D'_1$) is configured to minimize said error signal e and to generate based on said linear parameters $P_{tot}$ the distributed parameters $P_d$.

5. Arrangement according to claim 1, further comprising:

a linear transfer element, which is configured and arranged such to generate based on said multi-modal distortion $u_d$ and said linear parameters $P_{tot}$ the total distortion $p_d$ in said measurement signal p; and a third subtraction element, which is configured and arranged such to generate based on the difference between the measurement signal p and the total distortion $p_d$ a linearized measurement signal $p_{out}$, whereas the linearized measurement signal $p_{out}$ contains a linear output signal $p_{lin}$ of said transducers and an ambient signal $p_s$ generated by an external source.

6. Arrangement according to claim 1, further comprising at least one of the following elements:

an electric sensor, which is configured and arranged such to measure an electric state variable of said transducer and to generate an electric measurement signal i, whereas said electric measurement signal i is different form said electrical excitation signal u supplied to the transducer;

a second parameter detector ($D_2$), which is configured and arranged such to generate based on electrical measurement signal i and said electrical excitation signal u lumped parameters $P_l$, whereas said lumped parameters $P_l$ represent the fundamental vibration mode of said transducer with the lowest natural frequency $f_0$ and determine the properties of said modal activation filter ($H_{e,0}$) of an order m=0;

a nonlinear network model ($N_l$), which is configured and arranged such to generate based on said excitation signal u and said lumped parameters $P_l$ a unimodal distortion signal $u_l$, whereas the unimodal distortion signal $u_l$ represents the signal distortion generated by the fundamental vibration mode of the order m=0;

an adder, which is configured and arranged such to generate based on the excitation signal u and said unimodal distortion signal $u_l$ a distorted excitation signal $u_c$; and a nonlinear wave model ($N_d$), which is configured and arranged such to generate based on said distorted excitation signal $u_c$ and said distributed parameters $P_d$ said multi-modal distortion $u_d$.

7. Arrangement according to claim 2, further comprising a unimodal synthesis element, which is configured and arranged such to generate based on said network model ($N_l$) and said lumped parameters $P_l$ a unimodal compensation signal $v_l$, whereas the unimodal compensation signal $v_l$ represents a unimodal distortion signal $u_l$ generated by said transducers contributing to said nonlinear total distortion $p_d$ in the output signal $p(r_a)$; and a fourth subtraction element, which is configured and arranged such to generate based on a difference between the control signal $v_c$ and said unimodal compensation signal $v_l$ the excitation signal u of said transducer.

8. Method for converting an electrical input signal v into a mechanical or an acoustical output signal $p(r_a)$ by using an electro-mechanical transducer and for reducing nonlinear total distortion $p_d$ in said output signal $p(r_a)$, whereas the nonlinear total distortion $p_d$ contains multi-modal distortion $u_d$ which are generated by nonlinear partial vibration of mechanical transducer components, the method comprising:

generating an electrical excitation signal u based on the input signal v;

exciting said transducers with said electrical excitation signal u;

measuring at least one mechanical or acoustical state variable ($p(r_s)$) of said transducer;

generating a measurement signal p, which represents said measured state variable;

assigning initial values to distributed parameters $P_d$ of a nonlinear wave model ($N_d$) representing said transducer, whereas the distributed parameters $P_d$ comprise modal information $H_{e,m}(s)$, which represents at least one activation mode, whereas the activation mode activates the nonlinear partial vibration of the mechanical components; and multi-modal information $H_{s,m,n}(s)$, which represents the properties of transfer modes generating the output signal $p(r_a)$;

generating a modal activation signal $q_m$ by low-pass filtering of said input signal v in a linear activation filter with a transfer function provided by said modal information $H_{e,m}(s)$, whereas the modal activation signal $q_m$ represents the vibration state of an activation mode;

generating a multi-modal signal $w_{m,n}$ by high-pass filtering of said input signal v in a linear transfer filter with a transfer function provided by said multi-modal information $H_{s,m,n}(s)$, whereas the multi-modal signal $w_{m,n}$ represents the nonlinear relationship between said modal activation signal $q_m$ and said multi-modal distortion $u_d$;

generating a distortion contribution $u_{m,n}$ by multiplying said modal activation signal $q_m$ with said multi-modal signal $w_{m,n}$ in a nonlinear connection element, whereas said distortion contribution $u_{m,n}$ represents components of said multi-modal distortion $u_d$;

generating updated values of said distributed parameters $P_d$ based on said measurement signal p and distortion contribution $u_{m,n}$ in a first parameter detector;

generating diagnostic information about the root cause of the multi-modal distortion $u_d$ based on said distributed parameters $P_d$ in a diagnostic system.

9. Method for converting an electrical input signal v into a mechanical or an acoustical output signal $p(r_a)$ by using an electro-mechanical transducer and for reducing nonlinear total distortion $p_d$ in said output signal $p(r_a)$, whereas the nonlinear total distortion $p_d$ contains multi-modal distortion $u_d$ which are generated by nonlinear partial vibration of mechanical transducer components, the method comprising:

generating distributed parameters $P_d$ of a nonlinear wave model ($N_d$) representing said transducer, whereas said distributed parameters $P_d$ comprise modal information $H_{e,m}(s)$, which represents at least one activation mode, whereas the activation mode activates the nonlinear partial vibration of the mechanical components; and multi-modal information $H_{s,m,n}(s)$, which represents the properties of the transfer modes generating the output signal $p(r_a)$;

generating a modal activation signal $q_m$ by low-pass filtering of said input signal v in a linear activation filter with a transfer function provided by said modal information $H_{e,m}(s)$, whereas the modal activation signal $q_m$ represents the vibration state of an activation mode;

generating a multi-modal signal $w_{m,n}$ by high-pass filtering of said input signal v in a linear transfer filter with a transfer function provided by said multi-modal information $H_{s,m,n}(s)$, whereas the multi-modal signal $w_{m,n}$ represents a nonlinear relationship between said modal activation signal $q_m$ and said multi-modal distortion $u_d$;

generating a powered signal $B_{m,n}$ in a homogenous nonlinear power system by setting said modal activation signal $q_m$ to the power with the exponent n−1;

generating a distortion contribution $u_{m,n}$ by multiplying said powered signal $B_m$ with said multi-modal signal $w_{m,n}$ in a nonlinear connection element, whereas said distortion contribution $u_{m,n}$ represents components of said multi-modal distortion $u_d$;

generating a multi-modal compensation signal $v_d$ based on said distortion contribution $u_{m,n}$;

generating a control signal $v_c=v-v_d$ based on said input signal v and said multi-modal compensation signal $v_d$ in a first subtraction element;

generating an excitation signal u based on said control signal $v_c$; and supplying the excitation signal u to the electrical input of said transducers.

10. Method according to claim 8, further comprising at least one of the following steps:

generating a nonlinear source signal $z_{m,n}$ by multiplying said powered signal $B_{m,n}$ with said multi-modal signal $w_{m,n}$ in a multiplier; and generating said distortion contribution $u_{m,n}$ of modal order m and nonlinear order n based on linear filtering of said source signal $z_{m,n}$, whereas the linear filter has a transfer function $H_{p,m,n}(s)$ which is determined by the distributed parameters $P_d$.

11. Method according to claim 8, further comprising:

generating a total signal $u_t$ in an adding device based on said excitation signal u and said multi-modal distortion signal $u_d$;

generating linear parameters $P_{tot}$ in a third parameter detector based on said excitation signal u and said measurement signal p, whereas the linear parameters $P_{tot}$ represent a linear relationship between said total signal $u_t$ and said measurement signal p;

generating an estimated signal p' in a linear total transfer element based on the total signal $u_t$ and said linear parameters $P_{tot}$, whereas the estimated signal p' represents the measurement signal p;

generating an error signal e in a subtraction element which represents the deviation between said measurement signal p and said estimated signal p'; and generating said distributed parameters $P_d$ by minimizing said error signal e based on said linear parameters $P_{tot}$.

12. Method according to claim 8, further comprising:

generating a linearized measurement signal $p_{out}$ based on said measurement signal p and said excitation signal u by using said nonlinear wave model with said distributed parameters $P_d$ and a linear transfer element with said linear parameters $P_{tot}$, whereas the linearized measurement signal $p_{out}$ contains a linear output signal $p_{lin}$ of said transducer and an ambient signal $p_s$ generated by an external source.

13. Method according to claim 8, further comprising:

generating a diagnostic information I based on said distributed parameters $P_d$ in a diagnostic system whereas the diagnostic information I reveals the physical causes of the nonlinear total distortion $p_d$ in the output signal $p(r_a)$ and is used for improving the design and manufacturing process of said transducer.

14. Method according to claim 8, further comprising at least one of the following steps:

generating an electrical measurement signal i by measuring an electrical state variable of said transducer by using an electric sensor, whereas said electric measurement signal i is different form said electrical excitation signal u supplied to the input of said transducer;

generating lumped parameters $P_l$ of a network model ($N_l$) representing said transducer at low frequencies in a second parameter detector based on said electrical measurement signal i and said electrical excitation signal u;

generating modal information $H_{e,0}(s)$ based on said lumped parameters $P_l$, wherein the modal information $H_{e,0}(s)$ represents the frequency response of the fundamental vibration mode of the order m=0 with the lowest natural frequency $f_0$;

generating a unimodal distortion signal $u_l$ in a nonlinear network model representing said transducer based on said excitation signal u and said modal information $H_{e,0}(s)$, whereas the unimodal distortion signal $u_l$ represents the signal distortion generated by the fundamental vibration mode of order m=0;

generating a distorted excitation signal $u_c$ in an adder based on the excitation signal u and said unimodal distortion signal $u_l$;

generating a modal activation signal $q_0$ of the order m=0 in said activation filter based on said excitation signal u and said modal information $H_{e,0}(s)$;

generating a multi-modal signal $w_{0,n}$ in said transfer filter based on said distorted excitation signal $u_c$ and said multi-modal information $H_{s,0,n}(s)$ provided in said distributed parameters $P_d$; and generating said multi-modal distortion $u_d$ in said connection element based on said modal activation signals $q_0$ and said multi-modal signal $w_{0,n}$.

15. Method according to claim 9, further comprising:

generating a unimodal compensation signal $v_l$ based on control signal $v_c$ and lumped parameters $P_l$ of a network model ($N_l$); and generating an excitation signal u based on the difference between the control signal $v_c$ and said unimodal compensation signal $v_l$.

* * * * *